US007234528B2

(12) United States Patent
Pallini, Jr. et al.

(10) Patent No.: US 7,234,528 B2
(45) Date of Patent: Jun. 26, 2007

(54) MULTI-PURPOSE SLEEVE FOR TIEBACK CONNECTOR

(75) Inventors: Joseph W. Pallini, Jr., Tomball, TX (US); Jeffery K. McCarty, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 165 days.

(21) Appl. No.: 11/072,019

(22) Filed: Mar. 4, 2005

(65) Prior Publication Data

US 2006/0196673 A1 Sep. 7, 2006

(51) Int. Cl.
*E21B 29/12* (2006.01)

(52) U.S. Cl. ..... 166/343; 166/348; 166/85.1

(58) Field of Classification Search ..... 166/343, 166/348, 368, 341, 334, 85.1
See application file for complete search history.

(56) References Cited

U.S. PATENT DOCUMENTS 5,255,743 A * 10/1993 Adam et al. ..... 166/345
5,299,642 A * 4/1994 Nelson et al. ..... 166/368
5,368,335 A * 11/1994 Dinnes ..... 285/18
5,450,904 A * 9/1995 Galle ..... 166/348
5,566,761 A * 10/1996 Pallini et al. ..... 166/345
6,260,624 B1 7/2001 Pallini, Jr. et al.
6,536,527 B2 * 3/2003 Munk et al. ..... 166/345
6,540,024 B2 * 4/2003 Pallini et al. ..... 166/348
7,025,145 B2 * 4/2006 Emmerson ..... 166/348

FOREIGN PATENT DOCUMENTS

EP 0338154 A1 10/1989

* cited by examiner

*Primary Examiner*—Thomas A Beach
(74) *Attorney, Agent, or Firm*—Bracewell & Giuliani LLP

(57) ABSTRACT

A tieback connector connects a riser between a subsea wellhead housing and a floating platform. The tieback connector has a tubular body that stabs into and seals with a casing hanger. A latch member on the tieback connector engages a locking profile to secure the tieback connector to the wellhead housing. A sleeve is slidably carried on the tubular body between a running-in position and a set position. The lower end of the sleeve lands on an upper rim of the casing hanger prior to the seal engaging the seal surface. Continued downward movement of the tubular body relative to the sleeve causes the seal to engage the seal surface and the sleeve to move to the set position. The sleeve has upper end that engages a lower end of the latch member to limit any upward movement of the casing hanger in the wellhead housing.

18 Claims, 3 Drawing Sheets

MULTI-PURPOSE SLEEVE FOR TIEBACK CONNECTOR

FIELD OF THE INVENTION

This invention relates in general to subsea wellhead assemblies, and in particular to a tieback connector that has a sleeve located on its lower end that serves as a stab guide, a seal protector, and a lockdown member for the casing hanger.

BACKGROUND OF THE INVENTION

A subsea wellhead assembly installed at the sea floor may be in water thousands of feet deep. During completion and certain production operations, components from a floating platform are lowered from the platform to engage the subsea wellhead assembly. Often, the components will have seals that are subject to being damaged while lowering through openings in the floating platform and also while being stabbed into the wellhead assembly. A remote operated vehicle ("ROV") may be used to help stab and guide the component being lowered from the surface vessel.

For example, one component comprises a tieback connector. A tieback connector connects a production riser between a subsea wellhead housing and the surface production platform. Typically a surface production tree locates at the upper end of the production riser on the production platform. A tieback connector normally has an tubular body with a lower end that stabs into the bore of a casing hanger. A seal on the lower end of the tieback body engages a seal surface in the casing hanger. The tieback connector has locking elements that lock into a profile in the wellhead housing. Care must be taken during running of the tieback connector to avoid damage to the seal, particularly while entering the bore of the wellhead housing. It is known to install a sleeve over the seal prior to lowering the tieback connector through the platform. However, an ROV must be employed to remove the sleeve prior to stabbing the tieback connector into the wellhead housing.

Casing hangers in subsea wells often will have a lockdown mechanism to resist upward movement of the casing hanger that may occur due to thermal growth during production. The lockdown member engages an upper end of the casing hanger and a grooved profile in the bore of the wellhead housing. Normally, installing the lockdown member requires an extra trip to be made with a running tool, costing valuable rig time.

SUMMARY OF THE INVENTION

In this invention, a sleeve is installed on the tubular body of a component to be lowered from a surface vessel into a wellhead member. In the preferred embodiment, the component comprises a tieback connector. The sleeve has a lower position with a lower end adjacent to the seal to prevent damage. The exterior of the sleeve is configured to serve as a stab guide to facilitate entry of the tieback connector into the wellhead housing. The sleeve lands on an upward facing shoulder in the wellhead housing, which is typically the upper end of a casing hanger. Continued downward movement of the connector body causes the connector body to move downward relative to the sleeve. This downward movement results in the seal sliding into engagement with the sealing surface in the casing hanger.

The tieback connector has a latch member that moves into engagement with a locking profile in the bore of the wellhead housing. The upper end of the sleeve contacts the lower end of the latch member as the latch member engages the locking profile. As a result, any upward force exerted on the sleeve due to the casing hanger tending to move upward transmits through the sleeve, latch member and into the wellhead housing. This load path prevents upward movement of the casing hanger, which could otherwise cause damage to the seal.

DETAILED DESCRIPTION OF THE INVENTION

Figure 1A:
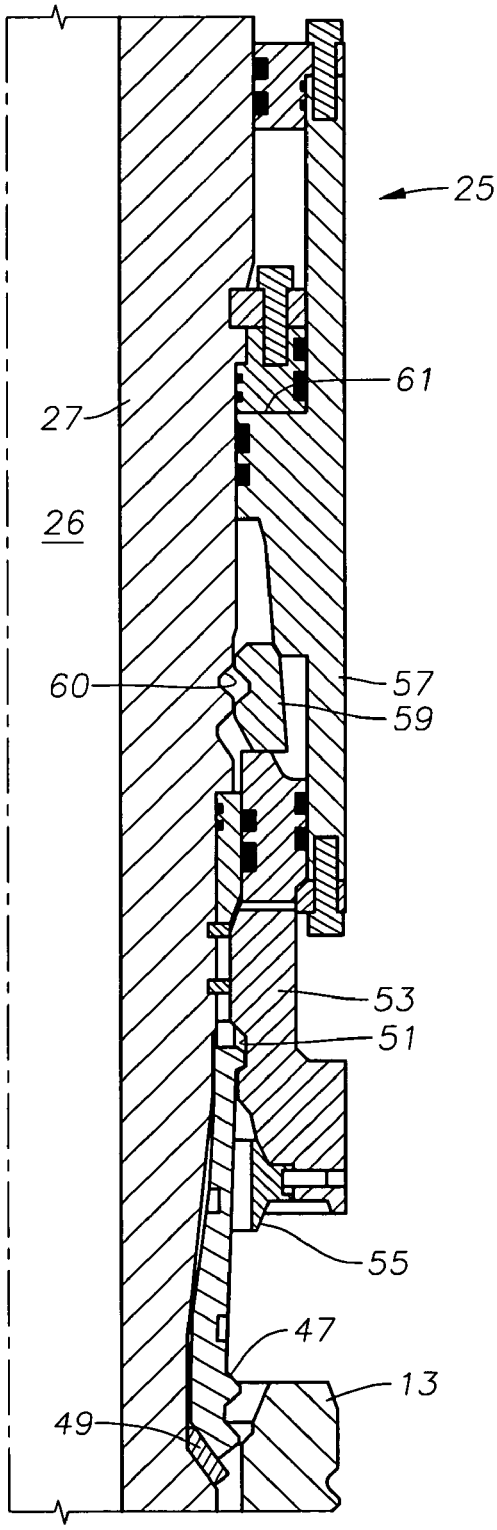
FIGS. 1A and 1B comprise a vertical quarter sectional view of a tieback connector in accordance with this invention, shown stabbing into a wellhead housing.
Figure 1B:
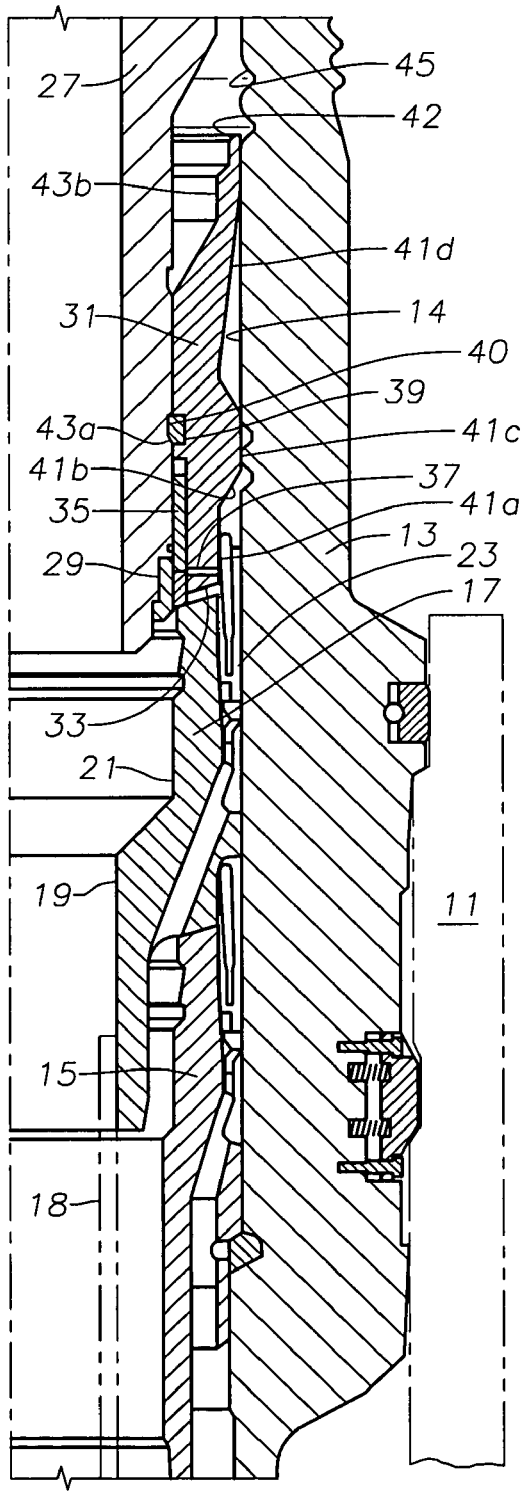

Referring to FIGS. 1A and 1B, a typical subsea wellhead assembly includes a low pressure or outer wellhead 11. Outer wellhead housing 11 is connected to a string of conductor pipe (not shown) that extends to a first depth in the well. An inner or high pressure wellhead housing 13 lands in low pressure wellhead 11. High pressure wellhead housing 13 is connected to casing (not shown) that extends into the well to a second depth. Wellhead housing 13 has a bore 14 into which at least one casing hanger 15 lands. In this embodiment, there are two casing hangers 15, 17, each of which is connected to a separate string of casing 18 extending into the well.

Casing hanger 17 has a bore 19 with an enlarged inner diameter in the upper portion containing a cylindrical seal surface 21. A packoff 23 seals between an exterior wall surface of casing hanger 17 and wellhead housing bore 14. It is not uncommon for a number of closely spaced wells to be drilled and installed with casing hangers 15, 17, then left for a period of time until a production platform is installed above for completing and producing the wells.

In this example, the well is to be completed with a surface Christmas or production tree (not shown) at the production platform. In the completion process, the operator lowers a production riser (not shown) into the sea with a tieback connector 25 on its lower end. Tieback connector 25 has an inner body 27 that is tubular and has a central axial passage 26 extending through it. A seal 29 is located on the lower end of tieback connector 25. Seal 29 may be of a variety of types and is adapted to seal against upper casing hanger seal surface 21. In this example, seal 29 is a metal U-shaped seal located near the lower end of inner body 27 and on the exterior of inner body 27. A threaded retainer ring 38 holds seal 29 in place. FIG. 1B shows tieback connector inner body 27 in the process of being lowered into wellhead housing bore 14, with seal 29 spaced above upper casing hanger 17.

A protector sleeve 31 is slidably carried on the lower exterior portion of inner body 27. Protector sleeve 31 has a lower end 33 that is located radially outward of seal 29 while protector sleeve 31 is in the lower position. In this lower position, protective sleeve 31 surrounds seal 29 to prevent damage in case inner body 27 is accidentally bumped against some other structure, such as part of the floating platform or the upper portion of wellhead housing 13.

Figure 2A:
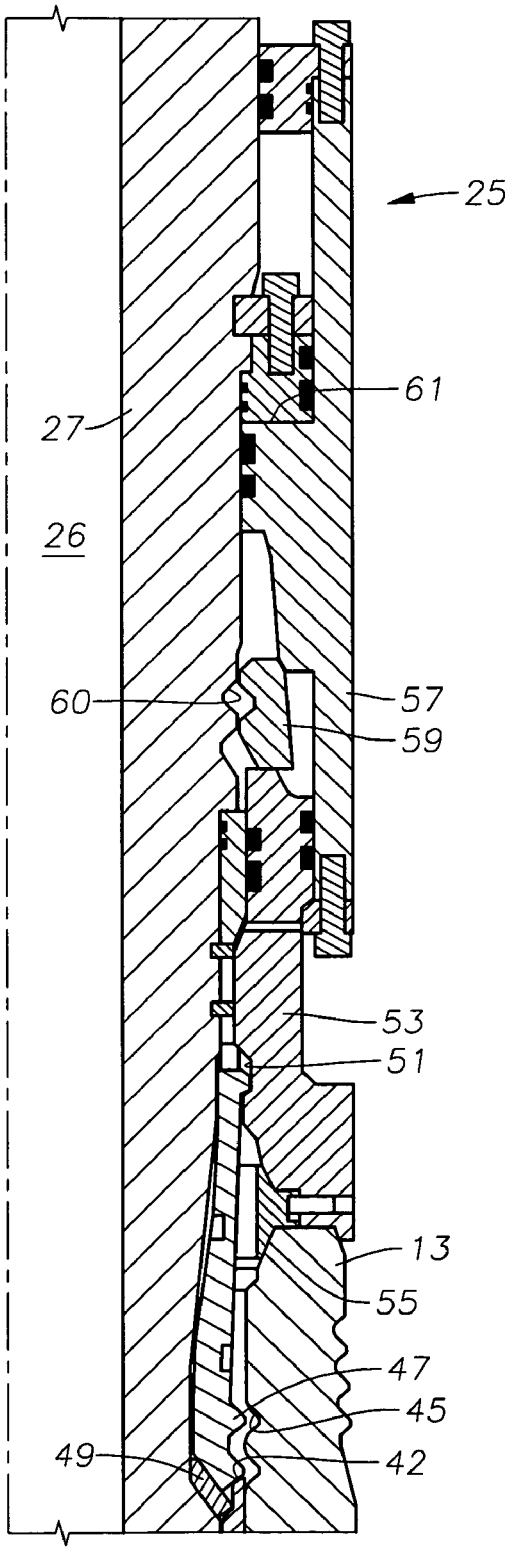
FIGS. 2A and 2B comprise a vertical quarter sectional view of the tieback connector of FIG. 1, shown landed in the wellhead housing, but not yet connected to the wellhead housing.
Figure 2B:
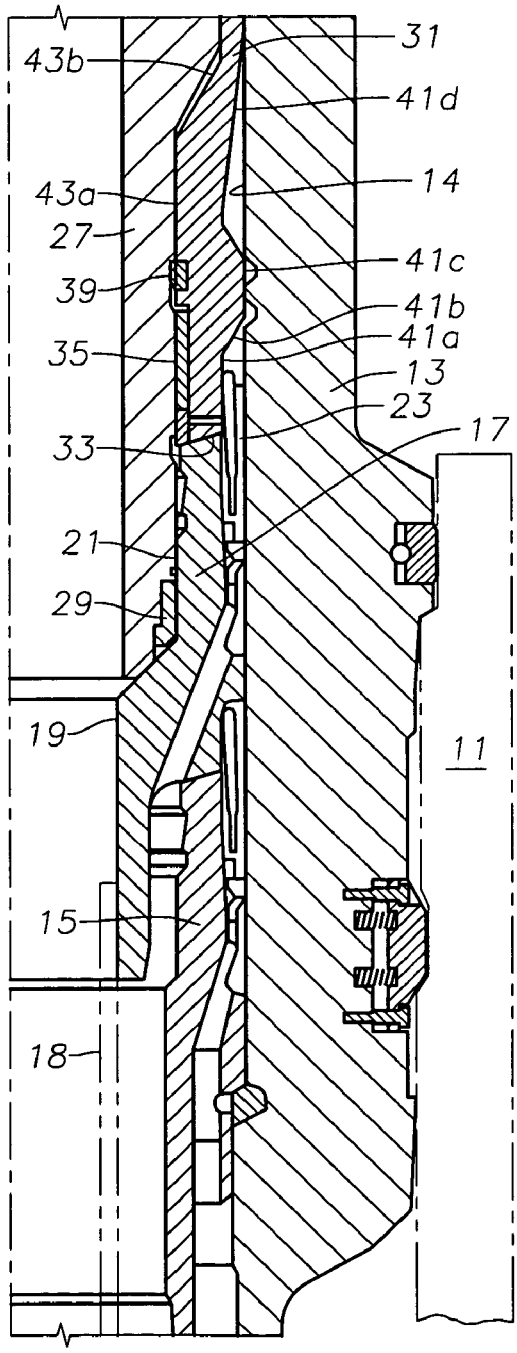
Figure 3A:
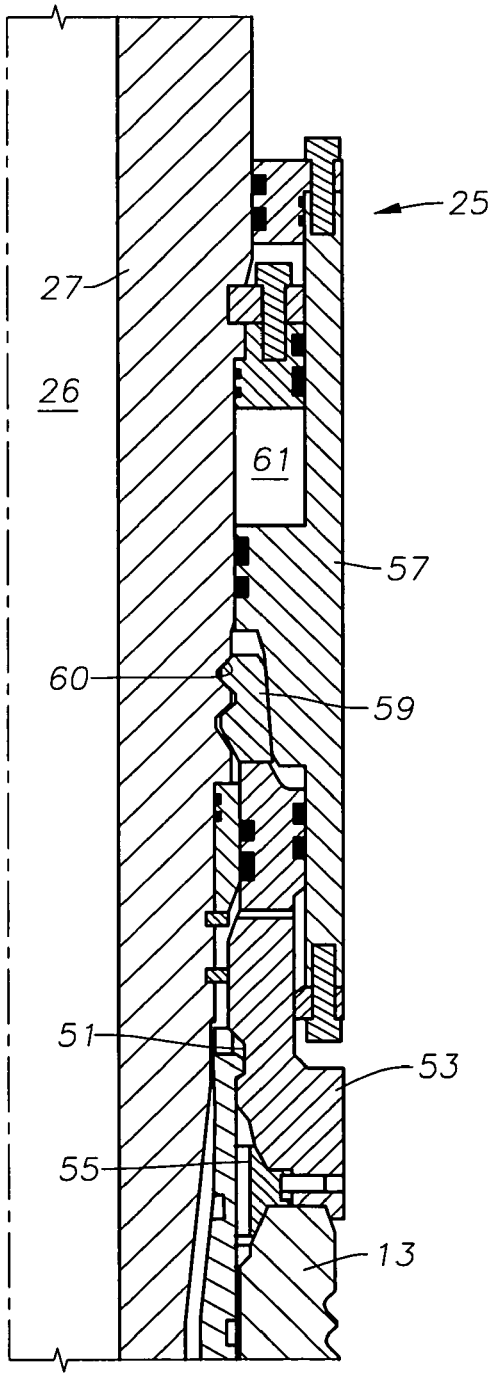
FIGS. 3A and 3B comprise a vertical quarter sectional view of the tieback connector of FIG. 1, showing the tieback connector landed and locked.
Figure 3B:
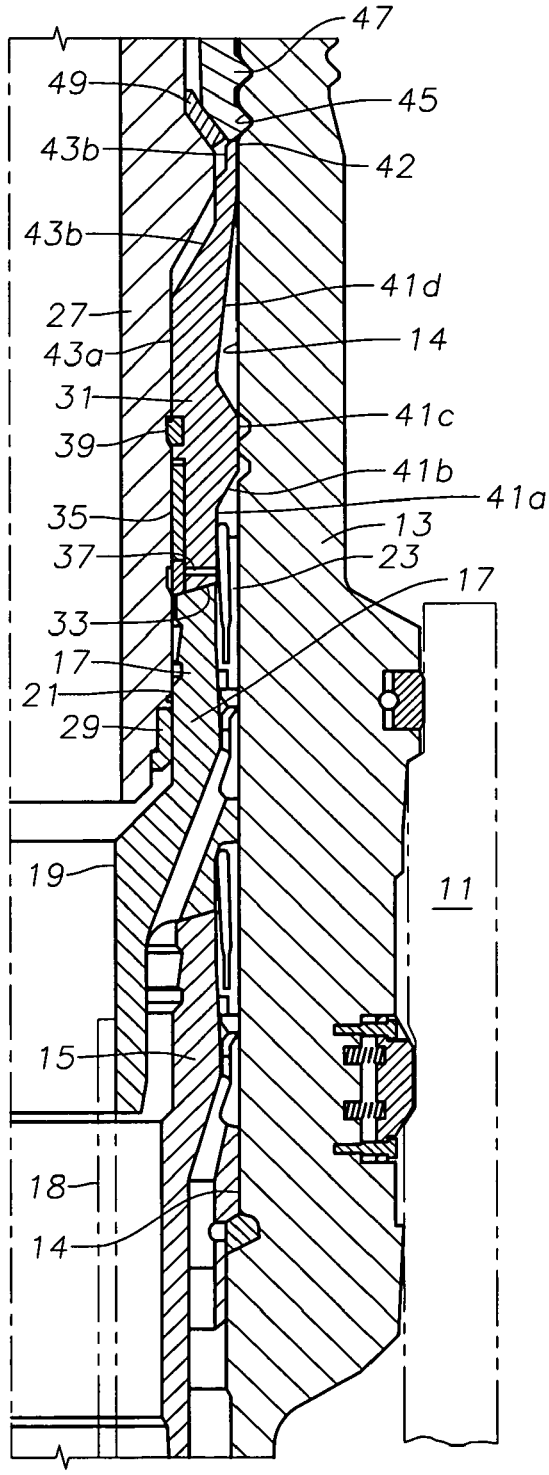

Protector sleeve 31 is releasably retained in the lower position shown in FIG. 1B, and inner body 27 is downwardly movable relative to protector sleeve 31, which positions protector sleeve 31 in the upper position shown in FIGS. 2B and 3B. The retaining mechanism could be of a variety of types. In the example shown, the retainer mechanism includes a trigger member or sleeve 35 located within the inner diameter of protector sleeve 31. Trigger sleeve 35 is located on the inner diameter of protector sleeve 31 and the exterior of tieback connector 25. Initially, trigger sleeve 35 is secured to by shear screws (not shown) to the outer diameter of inner body 27. Shear pins 37 connect trigger sleeve 35 to protector sleeve 31 but do not extend into engagement with inner body 27. In the running-in position, trigger sleeve 35 protrudes slightly downward past lower end 33 of protector sleeve 31.

A split retainer ring 39 is carried within a recess in the inner diameter of protective sleeve 31 above trigger sleeve 35. Retainer ring 39 releasably engages a groove 40 on the outer diameter of inner body 27. A thin upper section of trigger sleeve 35 extends upward into engagement with the inner side of retainer ring 39, which is inclined. Shear pins 37 are selected to shear upon the application of a preselected weight. In this embodiment, retainer ring 39 will not release protector sleeve 31 until shear pins 37 shear. In the point of initial contact of trigger sleeve 35 with the upper end of casing hanger 17, as shown in FIG. 1B, protector sleeve lower end 33 is spaced slightly above the upper end of upper casing hanger 17. Continued application of weight to inner body 27 causes shear pins 37 to shear and the shear screws (not shown) holding trigger sleeve 35 to shear, allowing protector sleeve 31 to move downward relative to trigger sleeve 35 until protector sleeve 31 lower end 33 lands on the upper end of casing hanger 17 as shown in FIG. 2B. During this downward movement, the thin upper end of trigger sleeve 35 cams or pushes retainer ring 39 radially outward out of engagement with groove 40. Continued weight on inner body 27 causes the lower end of inner body 27 to move downward to the position shown in FIG. 2B, with seal 29 engaging seal surface 21.

Protector sleeve 31 has an exterior with a reduced diameter portion 41*a* at its lower end. The outer diameter at lower portion 41*a* is substantially the same as the outer diameter of the upper end of casing hanger 17, which is smaller than the inner diameter of bore 14. A tapered transition area 41*b* extends from lower portion 41*a* upward. Transition portion 41*b* joins an enlarged diameter portion 41*c* that is only slightly smaller than the inner diameter of bore 14. A recessed portion 41*d* extends upward from enlarged diameter portion 41c. In this embodiment, recessed portion 41*d* is generally concave and joins a full diameter portion at upper end 42, which has the same outer diameter as enlarged diameter portion 41*c*. In this embodiment, recessed portion 41*d* has an axial length that is greater than the axial distance from lower end 33 to the upper edge of enlarged diameter portion 41*c*. Exterior portions 41*a*, 41*b*, 41*c* and 41*d* serve as a stab guide to assist in stabbing tieback connector 25 into bore 14. Recessed portion 41*d* increases the maximum permissible stabbing angle relative to the axis of wellhead housing 13.

The axial length of protector sleeve 31 is dimensioned so that it slightly exceeds the distance from the upper end of upper casing hanger 17 to the lower edge of a locking profile 45. Casing hanger 17 lands within wellhead housing 13 within a selected tolerance, and the length of protector sleeve 31 is selected so that upper end 42 will protrude slightly above the lower edge of locking profile 45 as long as casing hanger 17 is set within tolerances. Locking profile 45 comprises one or more grooves formed in wellhead housing bore 14.

Protector sleeve 31 has a central bore portion 43*a* above trigger sleeve 35 that substantially equals the adjacent outer diameter of inner body 27. An upper bore portion 43*b* extends upward from central bore portion 43*a* and has two or more conical transitions to a largest inner diameter at upper end 42. The wall thickness at upper end 42 is much thinner than the wall thickness of protector sleeve 31 at any other point in this example.

A latch 47 is carried by inner body 27 for engaging locking profile 45. Latch 47 may be of a variety of types. In this embodiment, latch 47 comprises a plurality of separate segments, defining a lower end that will radially expand from the position shown in FIG. 1A to the position shown in FIG. 3B. In the position shown in FIG. 1A, the outer diameter of latch 47 is slightly less than the inner diameter of wellhead housing bore 14. In this embodiment, the lower end of latch 47 slidingly engages a washer 49 located on a shoulder formed on inner body 27. When in the engaged position of FIG. 3B, protector sleeve upper end 42 will be in engagement with the lower end of latch 47. Latch 47 has an upper end that hooks into a recess 51 of a collar 53 as shown in FIG. 1A. Collar 53, which is carried on the exterior of inner body 27, lands on the upper end of high pressure wellhead housing 13. A seal 55 locates between collar 53 and wellhead housing 13.

A cam sleeve 57 is slidably carried on the exterior of inner body 27. Cam sleeve 57 has an exterior surface that is inclined for moving a split lock ring or locking member 59 inward while in the lower position. Locking ring 59 engages an upper grooved profile 61 formed on the exterior of inner body 27. A hydraulic fluid chamber 61 is formed between cam sleeve 57 and inner body 27 for causing downward movement of cam sleeve 57 when supplied with fluid pressure.

In operation, initially the well will be drilled to a first depth and low pressure wellhead 11 installed. A conductor pipe secured to the lower end of wellhead 11 extends into the well to a first depth. The operator drills the well to a greater depth and runs a string of casing, with the upper end of the casing being secured to the lower end of high pressure wellhead housing 13. The operator drills even greater depths and installs additional strings of casing 18, each on a casing hanger 15, 17 that lands in bore 14 of wellhead housing 13.

When the operator wishes to tieback the well to a surface production facility, he will lower tieback connector 25 on a string of production riser (not shown). Protector sleeve 31 will be in the lower position shown in FIGS. 1A, 1B, surrounding seal 29. Tieback connector 25 enters bore 14 guided by protector sleeve 31. Trigger sleeve 35 lands on the upper end of casing hanger 17 with lower end 33 of protector sleeve 31 spaced slightly above the upper end of casing hanger 17, as shown in FIG. 1B. This landing informs the operator that tieback connector 25 is in the position of FIGS. 1A and 1B. The operator applies sufficient weight to cause the shear screws (not shown) between trigger sleeve 35 to shear and shear pins 37 to shear, enabling protector sleeve 31 and inner body 27 to move downward relative to trigger sleeve 35. This downward movement causes trigger sleeve 35 to push retainer ring 39 out of groove 40, which allows inner body 27 to move down to the position shown in FIG. 2B. The lower end 33 of protector sleeve 31 will now be in contact with the upper end of casing hanger 17. Seal 29 will be into sealing engagement with casing hanger seal surface 21. Collar 53 will be landed on the upper end of wellhead housing 13.

As shown in FIG. 2A, latch 47 will not yet be in locking engagement with locking profile 45, and locking member 59 will not be in locking engagement with locking grooves 60. Locking member 59 will be spaced slightly above a matching alignment with grooves 60.

The operator then supplies hydraulic fluid pressure to chamber 61 (FIG. 2A), which causes cam sleeve 57 to move downward relative to inner body 27. The downward movement of cam sleeve 57 forces locking member 59 into locking grooves 60. As locking member 59 aligns with locking grooves 60, inner body 27 is forced to move upward relative to collar 53 and latch 47. During this upward movement, an exterior portion of inner body 27 pushes the lower end of latch member 47 radially outward into engagement with locking profile 45, as shown in FIG. 3B. The lower end of latch member 47 will touch upper end 42 of protector sleeve 31 before fully engaging the locking profile 45. The upward force on inner body 27 caused by hydraulic fluid pressure in chamber 61 provides a selected amount of preload force to the engagement of protector sleeve upper end 42 and latch member 47.

The operator completes the well in a conventional manner. Typically, this includes running a string of tubing (not shown) from the floating production platform through the riser and tieback connector passage 26 into the well. The operator perforates the well and installs a Christmas tree (not shown) at the upper end of the riser. The well fluid flows upward through the tubing to the Christmas tree.

During production, thermal growth may tend to cause casing hanger 17 to move upward in wellhead housing 13. This upward movement will be resisted by protector sleeve 31 since upper end 42 of protector sleeve 31 is in firm contact with the lower end of latch member 47. Any upward force will transmit through protector sleeve 31 to the lower end of latch member 47 and from there into locking profile 45 and wellhead housing 13.

The invention has significant advantages. The protector sleeve serves as a stab guide for the tieback connector while entering the bore of the wellhead housing. The protector sleeve provides protection to the seal located on the lower end of the inner body of the tieback connector. The seal is exposed only after it is safely within the bore of the wellhead housing. The protector sleeve also serves as a lockdown to resist upward movement of the casing hanger due to thermal growth.

While the invention has been shown in only one of its forms, it should be apparent to those skilled in the art that it is not so limited but susceptible to various changes without departing from the scope of the invention. For example, although the protector sleeve is shown in connection with a tieback connector, it could be utilized with other components lowered into engagement with subsea wellhead members. The latching of the tieback connector could be accomplished with other types of locking members. The lower end of the protector sleeve need not completely surround the seal in order to provide adequate protection.

The invention claimed is:

1. In a subsea wellhead assembly having a tubular wellhead member, an upward facing shoulder in the wellhead member, a seal surface in the wellhead member below the shoulder, the improvement, comprising:

a tubular body adapted to be lowered from a surface platform into the wellhead member;

a seal on the tubular body that sealingly engages the seal surface; and a sleeve that lands on the shoulder and is slidably carried on an exterior portion of the tubular body for movement between a lower position, wherein a portion of the sleeve surrounds at least a portion of the seal, and an upper position, the sleeve being in the lower position to protect the seal while the tubular body is being lowered into the wellhead member and moving to the upper position in response to continued downward movement of the tubular body after the sleeve lands on the shoulder.

2. The wellhead assembly according to claim 1, wherein the seal is located adjacent a lower end of the tubular body, and a lower portion of the sleeve surrounds the seal while in the lower position.

3. The wellhead assembly according to claim 1, further comprising:

a radially expansible retainer ring located between the sleeve and the tubular body for releasably retaining the sleeve in the lower position; and a trigger member releasably retained with the sleeve and engageable with the retainer ring, the trigger member having a running-in position protruding below the sleeve for contacting the shoulder, whereupon, continued downward movement of the tubular body causes the trigger member to release the retainer ring to allow the tubular body to move downward relative to the sleeve.

4. The wellhead assembly according to claim 1, wherein the shoulder comprises an upper end of a casing hanger landed in the wellhead member, and the seal surface is located within an inner bore of the casing hanger.

5. The wellhead assembly according to claim 1, further comprising:

a locking profile in the wellhead member above the shoulder;

a latch member carried above the sleeve by the tubular body that moves into engagement with the locking profile;

a casing hanger landed in the wellhead member, the shoulder in the wellhead member comprising an upper end of the casing hanger, and the seal surface in the wellhead member comprising a bore of the casing hanger; and wherein the sleeve has an upper end that contacts a lower end of the latch member while the latch member is in engagement with the locking profile to transfer to the wellhead member any upward force exerted on the sleeve by the casing hanger.

6. The wellhead assembly according to claim 1, further comprising:

a sleeve retainer between the sleeve and the tubular body for releasably retaining the sleeve in the lower position;

a trigger member positioned to contact the shoulder prior to the sleeve contacting the shoulder; and a shearable member between the sleeve and the trigger member that shears upon application of sufficient weight on the trigger member to cause the trigger member to move relative to the sleeve to release the sleeve retainer.

7. The wellhead assembly according to claim 1, wherein the sleeve has an exterior stab guide surface with a reduced outer diameter portion, an enlarged outer diameter portion above the reduced outer diameter portion, and a tapered transition portion extending between the reduced outer diameter and enlarged outer diameter portions.

8. The wellhead assembly according to claim 1, wherein the sleeve has a bore therethrough, the bore of the sleeve having a larger diameter at an upper end of the sleeve than at a lower end of the sleeve.

9. The wellhead assembly according to claim 5, wherein the upper end of the sleeve is spaced below the lower end of the latch member by a clearance while the sleeve is in the lower position.

10. A wellhead assembly having a tubular wellhead housing with a bore having a locking profile, a casing hanger landed in the bore below the locking profile, a tieback connector having a tubular body with a seal thereon, the tubular body stabbing into the casing hanger and engaging a seal surface of the casing hanger with the seal, and a latch member on the tieback connector that engages the locking profile to secure the tieback connector to the wellhead housing, the improvement comprising:

a sleeve slidably carried on the tubular body between a running-in position and a set position, the sleeve having a lower end that locates adjacent the seal in the running-in position, the lower end of the sleeve landing on an upper rim of the casing hanger prior to the seal engaging the seal surface, whereupon continued downward movement of the tubular body relative to the sleeve causes the seal to engage the seal surface and the sleeve to move to the set position; and the sleeve having an upper end that engages a lower end of the latch member when the latch member is in engagement with the locking profile to transfer to the latch member and the wellhead housing any upward force due to upward movement of the casing hanger in the wellhead housing, the upper end of the sleeve being spaced below the lower end of the latch member by a clearance while in the running-in position.

11. The wellhead assembly according to claim 10, wherein the lower end of the sleeve surrounds at least a portion of the seal while in the running-in position to protect the seal from damage.

12. The wellhead assembly according to claim 10, wherein the sleeve has an exterior stab guide surface with a tapered portion increasing in diameter in an upward direction, an enlarged outer diameter central portion above the tapered portion, a concave portion above the central portion, and an enlarged outer diameter upper portion above the concave portion.

13. The wellhead assembly according to claim 10, wherein the sleeve has a bore therethrough, the bore of the sleeve having a larger diameter at the upper end of the sleeve than at the lower end of the sleeve.

14. The wellhead assembly according to claim 10, further comprising:

a sleeve retainer located between the sleeve and the tubular body for releasably retaining the sleeve in the running-in position;

a tubular trigger member carried between the tubular body and the sleeve and engageable with the retainer ring; and a shearable member between the trigger member and the sleeve, the trigger member having a running-in position protruding below the sleeve for contacting the upper end of the casing hanger, whereupon, continued downward movement of the tubular body shears the shearable member, which causes the tubular body to move downward relative to the trigger member and the trigger member to release the sleeve retainer, allowing the tubular body to move downward relative to the sleeve.

15. A method of landing a tubular body within a subsea tubular wellhead member having a bore with an upward facing shoulder and a seal surface located therein, the tubular body having a seal located thereon, the method comprising:

mounting a sleeve on the tubular body for sliding relative movement;

lowering the tubular body from a surface platform into the sea while the lower portion of the sleeve surrounds at least a portion of the seal to protect the seal from damage; then landing the sleeve on the shoulder in the bore of the wellhead member; then lowering the tubular body relative to the sleeve, causing the seal to engage the seal surface.

16. The method according to claim 15, further comprising:

moving a latch member carried by the tubular body into engagement with a locking profile in the bore of the wellhead member;

placing an upward-facing surface of the sleeve in contact with a lower portion of the latch member while the latch member is in engagement with the locking profile; and transferring any upward forces exerted by the shoulder in the wellhead member through the sleeve and the lower portion of the latch member to the wellhead member.

17. The method according to claim 15, wherein the shoulder comprises an upper end of a casing hanger landed in the wellhead member, and the seal surface is located within an inner bore of the casing hanger.

18. The method according to claim 15, further comprising:

retaining the sleeve and the tubular body for movement therewith by a retainer prior to landing the sleeve on the shoulder; and triggering the retainer with a trigger member to release the sleeve to move relative to the tubular body by contacting the trigger member with the shoulder prior to landing the sleeve on the shoulder.

* * * * *